US006782809B2

(12) United States Patent
Bodecker

(10) Patent No.: US 6,782,809 B2
(45) Date of Patent: Aug. 31, 2004

(54) DEVICE FOR COMPRESSING A LOAD OF PARTICULATE MATERIAL

(76) Inventor: Thomas F. Bodecker, Box 737, Marysville, British Columbia (CA), V0B 1Z0

( * ) Notice: Subject to any disclaimer, the term of this patent is extended or adjusted under 35 U.S.C. 154(b) by 258 days.

(21) Appl. No.: 10/022,532

(22) Filed: Dec. 20, 2001

(65) Prior Publication Data

US 2002/0078835 A1 Jun. 27, 2002

(30) Foreign Application Priority Data

Dec. 27, 2000 (CA) ..... 2329634

(51) Int. Cl.[7] ..... B30B 3/02
(52) U.S. Cl. ..... 100/65; 100/100; 100/210
(58) Field of Search ..... 100/65, 66, 67, 100/68, 100, 210

(56) References Cited

U.S. PATENT DOCUMENTS 3,174,632 A 3/1965 Eynon
3,252,593 A 5/1966 Eynon
3,840,134 A * 10/1974 Luscombe ..... 414/501
3,941,047 A * 3/1976 Orlando et al. ..... 100/100
4,036,125 A * 7/1977 Mezei ..... 100/100
4,060,028 A * 11/1977 Luscombe ..... 100/100
4,077,189 A * 3/1978 Hering ..... 56/11.9
4,633,776 A 1/1987 Blackmore et al.
5,640,900 A 6/1997 Walton
5,735,195 A * 4/1998 Hewitt et al. ..... 100/65

* cited by examiner

*Primary Examiner*—Allen Ostrager
*Assistant Examiner*—Jimmy T Nguyen
(74) *Attorney, Agent, or Firm*—Antony C. Edwards

(57) ABSTRACT

The device for compressing a load of particulate material in an open-top trailer includes a frame mounted or mountable on a support so as to be elevated over the load of particulate material in the open-top trailer, a drum roller rotatably mounted or mountable to the frame, and a windrower mounted or mountable to the frame adjacent the drum roller. The windrower is for windrowing a heaped portion of the load of particulate material so as to heap the heaped portion above upper edges of sides of the trailer. The windrower windrows the heaped portion into a windrow of particulate material generally centrally aligned with a longitudinal axis of the trailer as the trailer and the windrower are translated relative to one another along the longitudinal axis. The drum roller is disposed on the frame so as to roll over and thereby compress the windrow of particulate material as the trailer and the roller translate relative to one another along the longitudinal axis.

8 Claims, 5 Drawing Sheets

DEVICE FOR COMPRESSING A LOAD OF PARTICULATE MATERIAL

CROSS REFERENCE TO RELATED APPLICATION

This application claims priority from Canadian patent Application No. 2,329,634 filed Dec. 27, 2000 entitled Device For Compressing A Load Of Particulate Material.

1. Field of the Invention

This invention relates to the field of loading open-top trailers with loads of chips, sawdust etc. and in particular, to a device for compressing such a load when the load is heaped above the upper edges of the trailer.

2. Background of the Invention

Conventional B-train chip trailers are 60 feet long and limited to approximately 8 and ½ feet in width. The trailers are rigid sided, the sides defining an open top into which is deposited a flow of chips, sawdust, etc. (hereinafter collectively referred to as particulate material) during loading of the trailers as the trailers are translated under a loading chute. Once loaded, the trailers are covered with a flexible tarp. Quite often the loading chutes allow for filling of the trailers until the particulate material is heaped up so as to extend above the top edges of the sides of the trailer.

The chute is generally centrally aligned with the trailer when the trailer is properly positioned for loading. The particulate material will thus be generally heaped along the longitudinal center-line of the trailers so that if the heaped load is groomed so as to compress and level the load, a further volume of particulate material can be accommodated. This may be done by adding an additional layer of particulate material or a thicker layer of particulate material. Once groomed and compressed, the flexible cover, such as a tarp, can still be positioned over the load. For a 60 foot long B-train adding an additional 6 foot wide 1 foot deep volume of particulate material may equate to approximately an extra 13 cubic yards of particulate material that can be packed into the trailers for hauling.

SUMMARY OF THE INVENTION

In summary the device of the present invention for compressing a load of particulate material in an open-top trailer includes a frame mounted or mountable on a support so as to be elevated over the load of particulate material in the open-top trailer, a drum roller rotatably mounted or mountable to the frame, and a windrower mounted or mountable to the frame adjacent the drum roller. The windrower is for windrowing a heaped portion of the load of particulate material so as to heap the heaped portion above upper edges of sides of the trailer. The windrower windrows the heaped portion into a windrow of particulate material generally centrally aligned with a longitudinal axis of the trailer as the trailer and the windrower are translated relative to one another along the longitudinal axis. The drum roller is disposed on the frame so as to roll over and thereby compress the windrow of particulate material as the trailer and the roller translate relative to one another along the longitudinal axis.

The windrower may have a converging load compression surface for slidably engaging and compressing the heaped portion of the load of particulate material. The load compression surface may be a funnel. The roller may extend along its axis of rotation so as to extend to at least the sides of the trailer.

DETAILED DESCRIPTION OF EMBODIMENTS OF THE INVENTION

Figure 1:
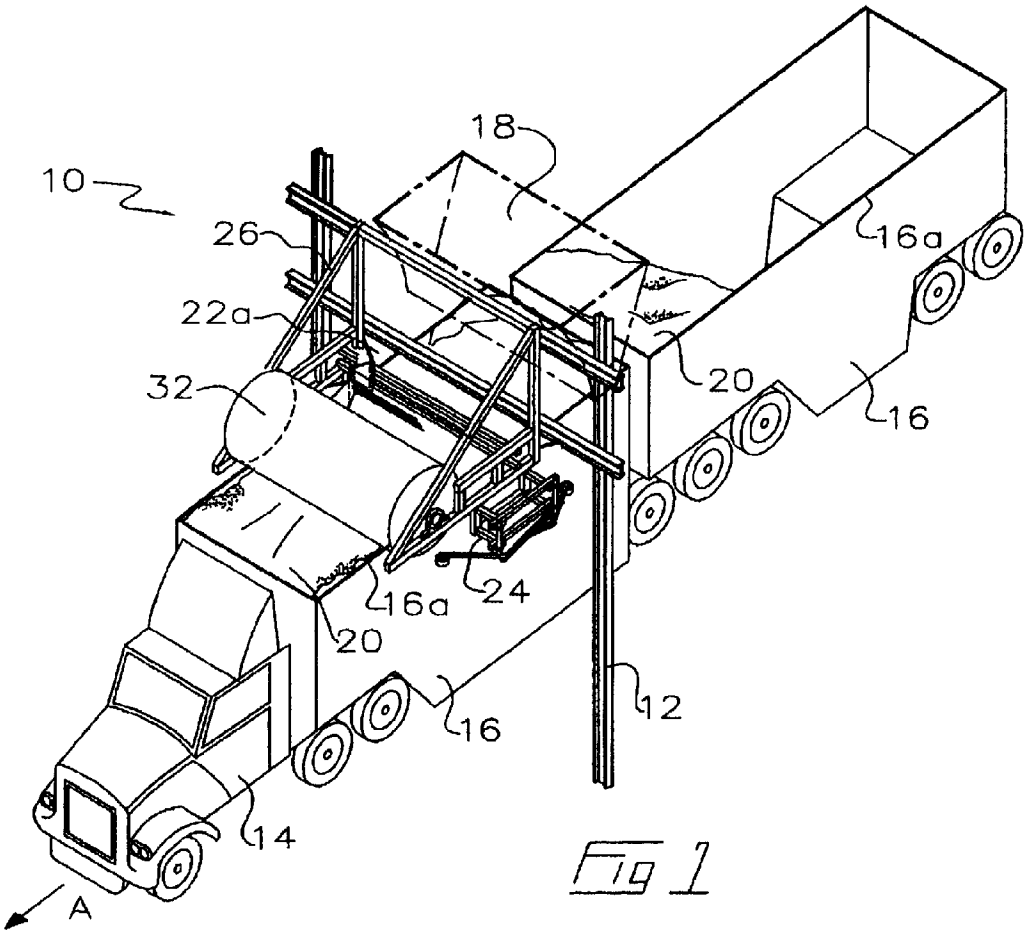
FIG. 1 is, in perspective view, the load compressing device of the present invention engaging a load of particulate material contained in a tractor drawn open-top trailer.
Figure 2:
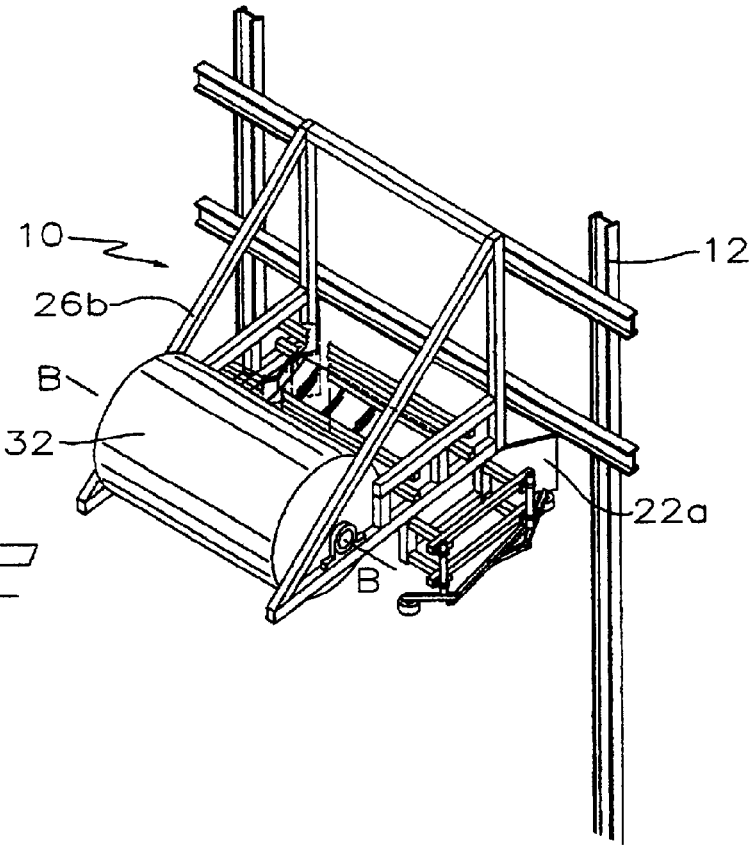
FIG. 2 is, in front perspective view, the load compressing device of FIG. 1.
Figure 3:
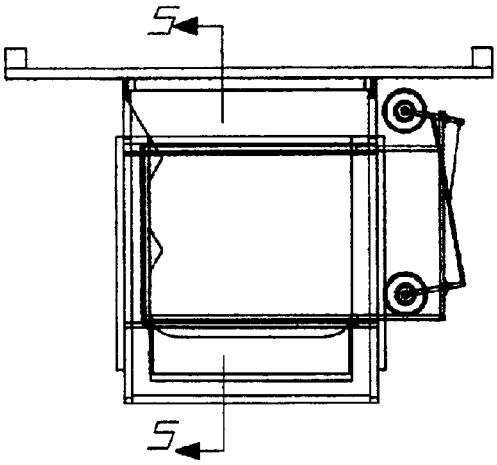
FIG. 3 is, in plan view, the load compressing device of FIG. 2.
Figure 4:
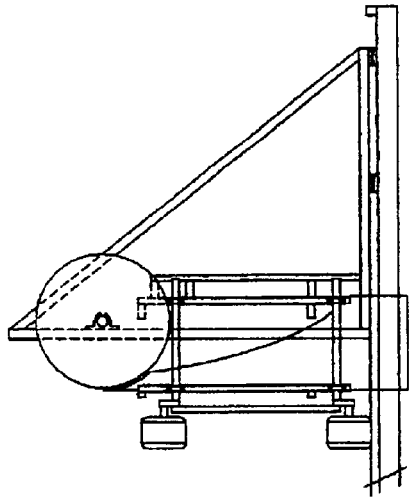
FIG. 4 is, in right side elevation view, the load compressing device of FIG. 3.
Figure 2A:
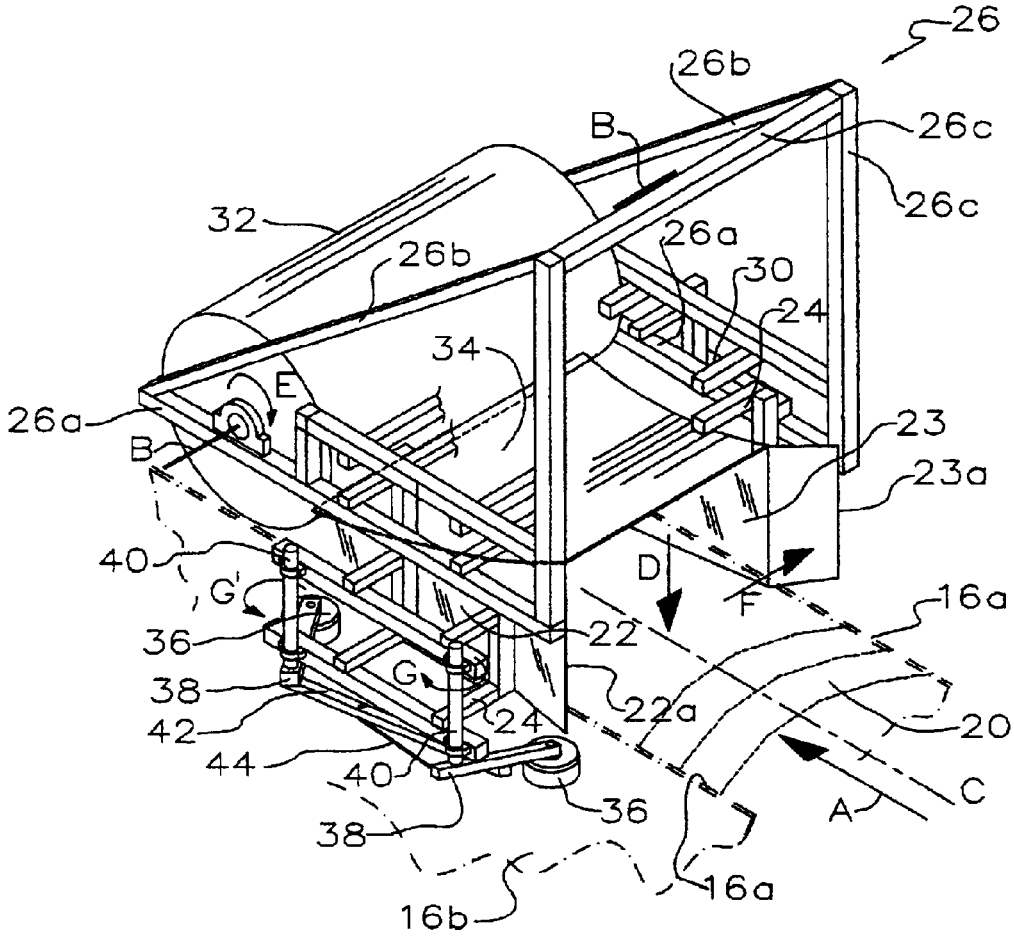
FIG. 2*a* is, in rear perspective view, the load compressing device of FIG. 2.
Figure 5:
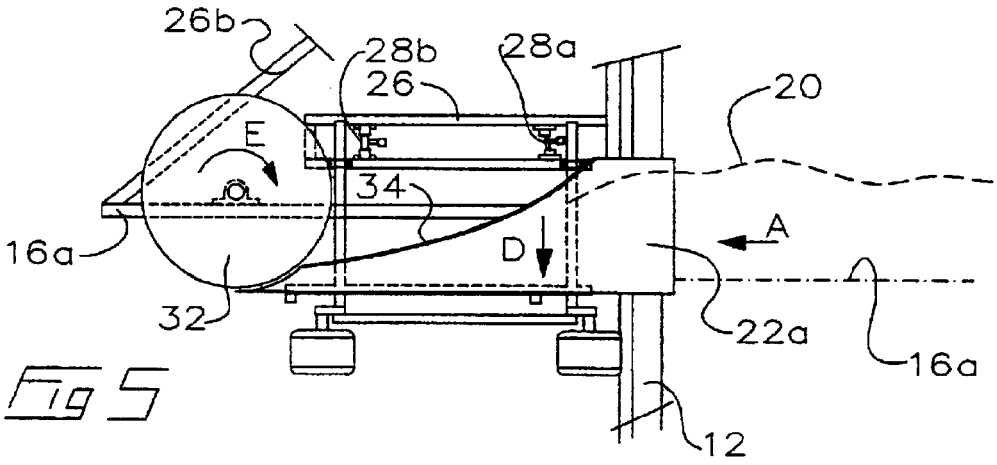
FIG. 5 is a sectional view along line 5—5 in FIG. 3.
Figure 6:
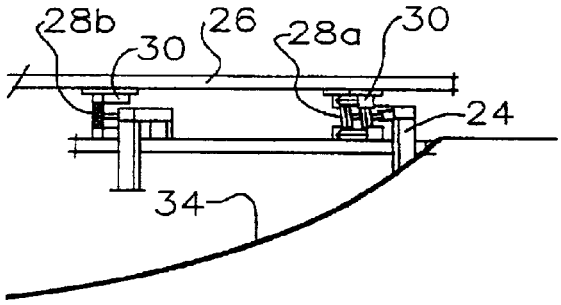
FIG. 6 is, in enlarged partially cut-away view, a portion of FIG. 5 illustrating the lateral roller arrangement.

As seen in FIG. 1, the device 10 for compressing a particulate load is mounted, either permanently, or temporarily, or by way of retrofit, onto a supporting framework 12. Framework 12 may, without intending to be limiting, have a pair of vertical supports positioned sufficiently far apart to allow the passing of a tractor 14 and open top trailers 16 therebetween. Horizontal cross members may be rigidly mounted to the upper ends of the vertical supports. Framework 12 may be positioned adjacent a conventional particulate feed chute 18 (shown in dotted outline) so that as tractor 14 and trailers 16 are translated thereunder in direction A, a load of particulate 20 may be deposited from chute 18 into trailers 16 prior to the heaped load of particulate 20 engaging downstream particulate load compressing device 10.

Figure 9:
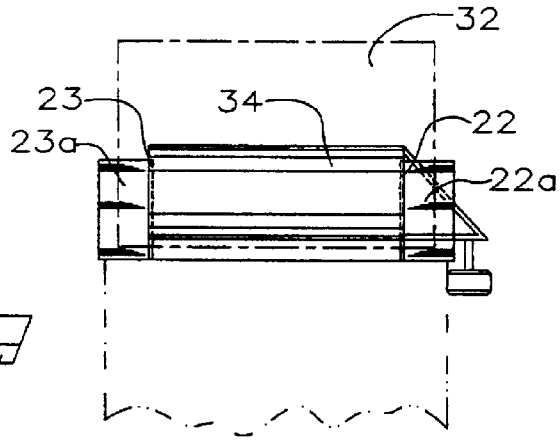
FIG. 9 is, in front elevation view, the load compressing device of FIG. 2*a*.

As better seen in FIGS. 1, 2, 2*a* and 3–6, as a load of particulate 20 is translated downstream in trailers 16 in direction A from under chute 18, the heaped load of particulate 20 extending above the sides of the trailer first engages side plates 22 and 23 mounted to sliding frame 24. Sliding frame 24 is laterally slidably mounted to rigid cantilevered frame 26, for example by means of rollers 28*a* and 28*b* running in or on guide tracks 30 rigidly mounted to cantilevered frame 26. A drum roller 32 is rotatably mounted to members 26*a* of cantilevered frame 26 so as to rotate about a laterally aligned axis of rotation B perpendicular to direction of translation A. Members 26*a* are supported within cantilevered frame 26 by cross struts 26*b* mounted to a backing frame 26*c*. As also seen in FIG. 9, drum roller 32 extends across the entire width of trailer 16 so as to run on top of the top edges 16*a* of the trailers. As may be seen, roller 32 may be fixed laterally relative to the support frame, and the windrower may be free to translate laterally relative to the support frame to adjust to the position of the trailer.

Side plates and 22 and 23 are mounted generally vertically on either side of the load of particulate 20, extending vertically between a curved upper funnel forming plate 34 and the upper edges 16*a* of trailer 16. The upstream ends of side plates 22 and 23 are flared outwardly of upper edges 16*a* by windrowing plates 22*a* and 23*a* respectively so that as the laterally outermost edges of the heaped load of particulate 20 are translated in direction A so as to engage the windrowing plates, the load is windrowed laterally inwardly of upper edges 16*a* towards center-line C of trailers 16. Particulate 20 then enters into the funnelled duct formed by the remaining downstream surfaces of side plates 22 and 23 formed contiguously with the windrowing plates 22*a* and 23*a* and the upper funnel forming plate 34. As the load of particulate 20 translates downstream in direction A, the funnelling duct precompresses the load downwardly in direction D, not (without intending to be limiting) in this embodiment because of any active actuation of, for example, funnel forming plate 34, but rather because of the relative movement between the load of particulate 20 moving into direction A so as to be compressed under the converging downstream end of the funnel forming plate. The load thus precompressed is finally compressed as drum roller 32 rotating in direction E rolls over the load which has been windrowed and precompressed so as to optimize the effectiveness of a single pass of the load under the drum roller.

Side plate 23 may be asymmetrically aligned relative to side plate 22 so that as the load initially engages windrowing plate 23*a*, the compressive forces of the load acting on windrowing plates 23*a* and 22*a* result in a lateral adjusting force F acting on side plate 23. Force F urges sliding frame 24 laterally on rollers 28 so as to adjust sliding frame 24 laterally relative to cantilevered frame 26 until wheels 36 rotatably mounted to sliding frame 24 resiliently engage side surface 16*b* of trailers 16 so as to arrest the lateral sliding movement of sliding frame 24 under the urging of force F.

Alternatively, although illustrated as fixed, the windrowing plates may be hinged so as to be pivotally mounted to the side plates for adjustable pivotal movement, for example about the intersection between the windrowing and side plates.

With wheels 36 engaging side surface 16*b* of trailer 16, windrowing plates 22*a* and 23*a* and corresponding side plates 22 and 23 are generally centrally aligned over the sides of trailer 16 so that the center of the load along center-line C passes substantially co-axially with a longitudinal axis of the funnelling duct formed by funnel forming plate 34 and side plates 22 and 23.

Wheels 36 maybe rotatably mounted on swing arms 38. Arms 38 may be pivotally mounted relative to sliding frame 24 on shafts 40. Swing arms 38 are pivotally interconnected by a cross arm 42 so that when wheels 36 engage side surface 16*b* of trailer 16, the compressive loading against wheels 36 in a direction opposite to force F rotate swing arms 38 in opposite directions G and G'. Resilient member 44, which may be a coil spring or other resilient means, urges rotation of swing arms 38 in directions G and G' so as to urge wheels 36 apart awaiting engagement with side surface 16*b* of trailer 16.

Figure 7:
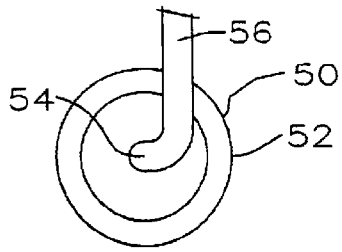
FIG. 7 is, in side elevation view, a shaft mounted windrowing wheel of an alternative embodiment of the present invention.
Figure 8:
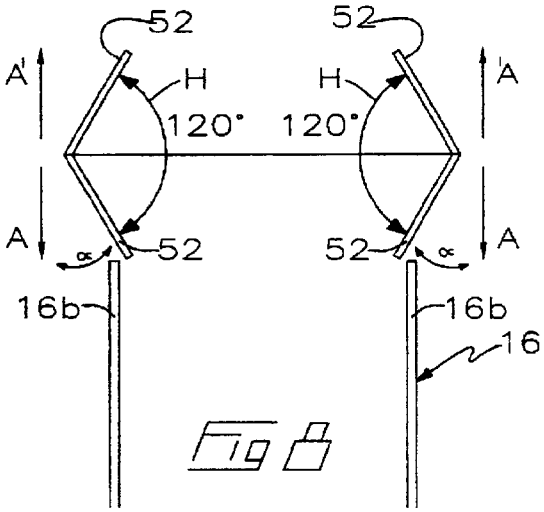
FIG. 8 is, in partially cut-away plan view, an opposed pair of the windrowing wheels of FIG. 7 engaging a load in a trailer.

In a further alternative embodiment, alternative to the fixed hinged windrowing plates or wings, two large diameter wheels or discs 50 as seen in FIG. 7 are employed to windrow the particulate. A flexible circumferential, radially outwardly extending flange 52 is mounted around the disc. The center hub 54 of disc 50 is rotatably and pivotally mounted to an offset vertical shaft 56, shaft 56 mounted to, for example, side plates 22 and 23 and upper funnel forming plate 34. Disc 50 pivots about shaft 56 in direction H, for example approximately 120 degrees as seen in FIG. 8 providing a castor-like pivoting effect. As trailers 16 pass underneath pivoting towards the funnel windrower (i.e. funnel plate 34), the discs initially positioned at approximately an angle $\alpha$ of 30 degrees relative to sides 16*b* of trailer 16 begin to rotate because of the resistance of the particulate load in which the discs are embedded. Once rotated, the discs and corresponding flanges windrow particulate towards the center of the funnel windrower. When the trailers change direction as when the driver backs up (direction A') the discs swing approximately 120 degrees, to again provide windrowing and grooming.

In a further alternative embodiment, device 10 may be selectively elevated, for example, by approximately two feet to disengage the device from a load of particulate and its corresponding trailer.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for compressing a load of particulate material in an open-top trailer comprising:

a frame mounted on a support so as to be elevated over a load of particulate material in an open-top trailer, a drum roller rotatably mounted to said frame, a windrower mounted to said frame adjacent said drum roller, said windrower for windrowing a heaped portion of said load of particulate material, said heaped portion heaped above upper edges of sides of said trailer, said windrower windrowing said heaped portion into a windrow of particulate material generally centrally aligned with a longitudinal axis of said trailer as said trailer and said windrower are translated relative to one another along said longitudinal axis, said drum roller disposed cm said frame so as to roll over and thereby compress said windrow of particulate material as said trailer and said roller translate relative to one another along said longitudinal axis.

2. The device of claim 1 wherein said windrower has a converging load compression surface for slidably engaging and compressing said heaped portion of said load of particulate material.

3. The device of claim 2 wherein said load compression surface is a funnel.

4. The device of claim 1 wherein said roller extends along its axis of rotation so as to extend at least said sides of said trailer.

5. A device for compressing a load of particulate material in an open-top trailer comprising:

a frame mountable on a support so as to be elevated over a load of particulate material in an open-top trailer, a drum roller rotatably mountable to said frame, a windrower mountable to said frame adjacent said drum roller, said windrower for windrowing a heaped portion of said load of particulate material, said heaped portion heaped above upper edges of sides of said trailer, said windrower windrowing said heaped portion into a windrow of particulate material generally centrally aligned with a longitudinal axis of said trailer as said trailer and said windrower are translated relative to one another along said longitudinal axis, said drum roller disposed on said frame so as to roll over and thereby compress said windrow of particulate material as said trailer and said toiler translate relative to one another along said longitudinal axis.

6. The device of claim 5 wherein said windrower has a converging load compression surface for slidably engaging and compressing said heaped portion of said load of particulate material.

7. The device of claim 6 wherein said load compression surface is a funnel.

8. The device of claim 5 wherein said roller extends along its axis of rotation so as to extend to at least said sides of said trailer.

* * * * *